US006557181B1

(12) United States Patent
Pham

(10) Patent No.: US 6,557,181 B1
(45) Date of Patent: May 6, 2003

(54) ORNAMENTAL ACCESSORY FOR INDICATING MARTIAL ARTS RANK

(76) Inventor: Vu N. Pham, 1111 Homestead Rd. North, Suite 25, Lehigh Acres, FL (US) 33936

( * ) Notice: Subject to any disclaimer, the term of this patent is extended or adjusted under 35 U.S.C. 154(b) by 0 days.

(21) Appl. No.: 10/043,453

(22) Filed: Jan. 10, 2002

(51) Int. Cl.[7] ..... A41F 19/00
(52) U.S. Cl. ..... 2/310
(58) Field of Search ..... 2/16, 22, 24, 338, 2/425, 468, 46, 50–52, 59, 127, 128, 129, 144, 145, 148, 149, 150, 151, 155, 156, 162, 170, 171, 207, 240, 303, 306, 309–322, 335, 910, 911, 917, 918, DIG. 11; D2/624, 625, 627, 638, 639, 739; 482/83, 87, 88, 10, 44, 79, 148; 24/31 R, 49.1, 50, 66.11; 63/1.11, 3, 20; 128/878, 879, 882; 602/20, 23, 26, 27, 61, 62, 63–65, 75

(56) References Cited

U.S. PATENT DOCUMENTS 3,439,360 A * 4/1969 Grubman ..... 2/130
3,848,270 A * 11/1974 Rand ..... 2/311
3,955,217 A * 5/1976 Levy ..... 2/150
5,299,325 A * 4/1994 Kamber et al. ..... 2/338
5,539,933 A * 7/1996 Garber et al. ..... 2/311

OTHER PUBLICATIONS

Merriam–Webster's Collegiate Dictionary, tenth edition, p. 996.*

* cited by examiner

*Primary Examiner*—John J. Calvert
*Assistant Examiner*—Tajash Patel
(74) *Attorney, Agent, or Firm*—William E. Noonan

(57) ABSTRACT

An ornamental accessory is designed for wearing by a person on a portion of the person's body. The accessory represents a selected martial arts skill level. The accessory includes a flexible band having generally flat inside and outside surfaces for encircling a portion of the wearer's body. A knot assembly, which is separate and distinct from and not unitary with the band includes at least one elongate, flexible and generally flat knot component. The one or more knot components are mounted to the outside surface of the band and depend therefrom to define a pair of tail portions. At least one of the band and the knot assembly includes indicia for representing a corresponding martial arts skill level.

6 Claims, 4 Drawing Sheets

ORNAMENTAL ACCESSORY FOR INDICATING MARTIAL ARTS RANK

FIELD OF THE INVENTION

This invention relates to an ornamental accessory and, in particular, a bracelet, anklet or similar item of jewelry that is intended to be worn and which indicates a rank or skill level that has been attained by the wearer in one of the martial arts.

BACKGROUND OF THE INVENTION

Participants in traditional scholastic sports are often awarded letters, letter jackets, pins, badges and similar honors to indicate and reward the wearer's participation in a particular sport. Presently, there is no comparable item designed to be worn in public for indicating that a particular martial arts skill level or ranking has been achieved by the wearer. Participants in the martial arts are normally awarded belts of various colors to represent the skill or rank that the wearer has achieved in a particular martial arts discipline. However, such belts are intended to be worn only while the participant is engaged in the relevant sport, i.e. during competition or training. Rarely, if ever, is a martial arts belt worn otherwise. By the same token, few, if any, items of jewelry or ornamental wearing apparel have been designed with a martial arts theme. This is not surprising in as much as the martial arts are not ostentatious or "showy" in nature and typically stress simplicity, modesty and self-discipline. Nonetheless, many participants in the marital arts naturally take great pride as they advance within their discipline and attain higher levels of skill. Younger participants tend to be especially anxious and excited to inform friends and fellow students of their martial arts accomplishments. A need currently exists for an ornamental item that can be worn by martial arts participants as a symbol of their rank or skill level within the sport.

SUMMARY OF THE INVENTION

It is therefore an object of the present invention to provide an ornamental accessory which clearly and attractively indicates that the wearer has achieved a particular martial arts skill level.

It is a further object of this invention to provide an attractive and interesting ornamental accessory which is designed to be worn by a martial arts participant and which enhances the wearer's pride and sense of accomplishment.

It is a further object of this invention to provide an ornamental accessory which provides an interesting, attractive and enjoyable indication of the wearer's martial arts accomplishments.

It is a further object of this invention to provide an ornamental accessory for martial arts participants, which allows the wearer to proudly, yet subtly represent his or her martial arts accomplishments.

It is a further object of this invention to provide an ornamental accessory for martial arts participants, which is designed to be worn as a bracelet, anklet, necklace or similar item of jewelry.

It is a further object of this invention to provide an ornamental accessory that conveniently indicates the wearer's martial arts ranking without requiring the wearer to don or display his or her martial arts belt.

This invention features an ornamental accessory for wearing by a person on a portion of the person's body in order to represent a selected martial arts skill level. The accessory includes a flexible band having generally flat inside and outside surfaces for encircling a portion of the wearer's body other than the torso. A knot assembly is separate and distinct from and not unitarily joined to the band. The knot assembly includes at least one elongate, flexible and generally flat knot component mounted on the outside surface of the band and depending therefrom to define a pair of tail portions. At least one of the bands in the knot assembly includes indicia for representing a corresponding martial arts skill level.

In a preferred embodiment, the band may include a continuous, generally annular member that is composed of a resilient material. Alternatively, the band member may include an elongate member having a pair of opposing ends. The elongate member may carry complementary means for fastening the elongate member to itself proximate the opposing ends to define the band. The complementary means may comprise a complementary pair of hook and loop fastening elements. A wide variety of alternative fasteners may also be utilized.

The knot assembly may include a single knot component that is tied to define the knot assembly and attached to the outside surface of the band. The knot assembly may be sewn to the outside surface of the band. In alternative embodiments, the knot assembly may include a pair of separate and distinct knot components. In such cases, the knot assembly may include a flexible loop element attached to the outside surface of the band. Each of the knot components may be attached to an outside surface of the loop element and insertible between the loop element and the band to form the knot assembly.

DETAILED DESCRIPTION OF PREFERRED EMBODIMENTS

Other objects, features and advantages will occur from the following description of a preferred embodiment and the accompanying drawings, in which.

Figure 1:
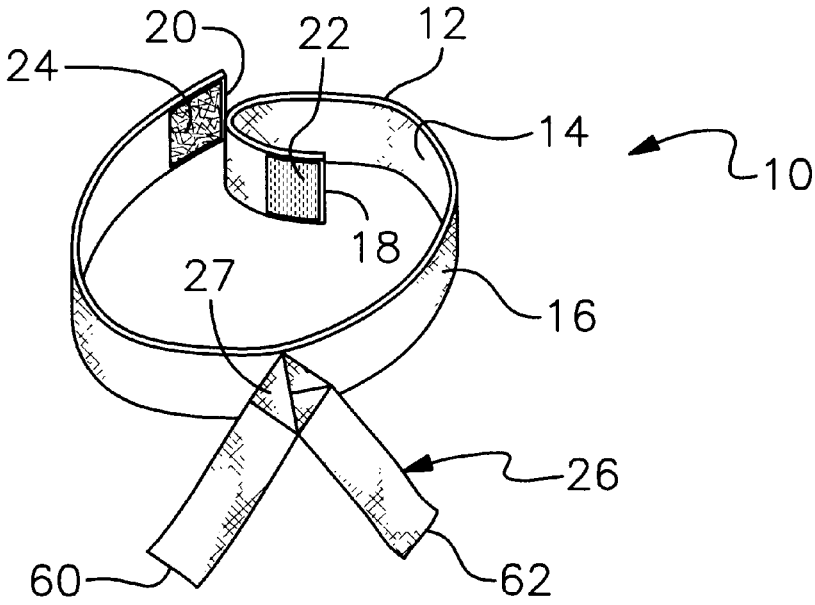
FIG. 1 is a perspective view of a preferred ornamental accessory in accordance with this invention, which accessory comprises a wrist band having complementary hook and loop fastening elements mounted thereon.

There is shown in FIG. 1 an ornamental accessory 10 in the form of a wrist band. It should be understood the ornamental accessory of this invention may comprise various types of jewelry or accessories which are intended for being worn as jewelry on or about a portion of the wearer's body. Typically, accessory 10 comprises a wrist band or ankle band. However, in certain embodiments, it may be worn about the leg, forearm, upper arm, neck, etc. Typically, the accessory is not designed for being worn about the torso of the body in the manner of a belt.

Accessory 10 includes a generally flat elongate band 12 that is intended to encircle the wearer's wrist, ankle, etc. Band 12 may be composed of various types of natural or synthetic fabric or other flexible material. In certain embodiments a flexible plastic may be employed. The material comprising the accessory 'should be fairly lightweight so that it can be worn in a comfortable manner. The band includes a generally flat inside surface 14 and a similarly flat outside surface 16. The outside surface typically carries a color or other indicia representing an associated martial arts skill. For example, in FIG. 1, the outside surface 16 is black in color to indicate that the wearer has achieved a "black belt" status in his or her particular sport. Band 16 may be longitudinally resilient so the size of the band may be adjusted. However, in certain embodiments, the band is composed of non-resilient material.

Band 12 includes opposing ends 18 and 20. Outer surface 16 carries a standard fastening component 22 which comprises one part of a conventional hook and loop (Velcro™) pair (e.g. hook material). Component 22 is secured adhesively, by sewing or otherwise to outer surface 16 proximate end 18. Analogously, inner surface 14 carries a complementary fastening component 24 proximate end 20. Component 24 typically comprises a complementary hook and loop element (e.g. loop material that is releasably and interlockably interengagable with component 22. Once again, component 24 is secured to the inside surface of the band by adhesive, sewing or other known means. When components 22 and 24 are separated, as shown in FIG. 1, band 12 may be opened so that the wearer can conveniently insert his or her wrist, ankle, etc. through the band. By interengaging components 22 and 24, the band is held in a closed condition about the wearer's body. To remove the band, the wearer simply separates components 22 and 24 by pulling them apart in a standard manner.

A separate and distinct knot assembly 26 is fastened to outside surface 16 of band 12. Knot assembly 26 may comprise one or two elongate pieces of generally flat fabric or other material similar to that comprising band 12. This material is configured, preferably in one of the manners described below, to define a knot 27 with two depending tail portions 60 and 62. The knot is secured to the outer surface 16 of band 12, once again, in the manner described below. Knot assembly 26 carries a design, color or other indicia identical or similar to that carried by the outer surface 16 of band 12. As a result, band 12 and knot assembly 26 together resemble a miniature belt representing a particular corresponding martial arts ranking or skill level. The wearer wraps band 12 about his or her wrist, ankle, leg or arm and fastens hook and loop components 22 and 24 together so that it appears that a miniature ornamental martial arts belt is being worn about the wearer's body.

Figure 2:
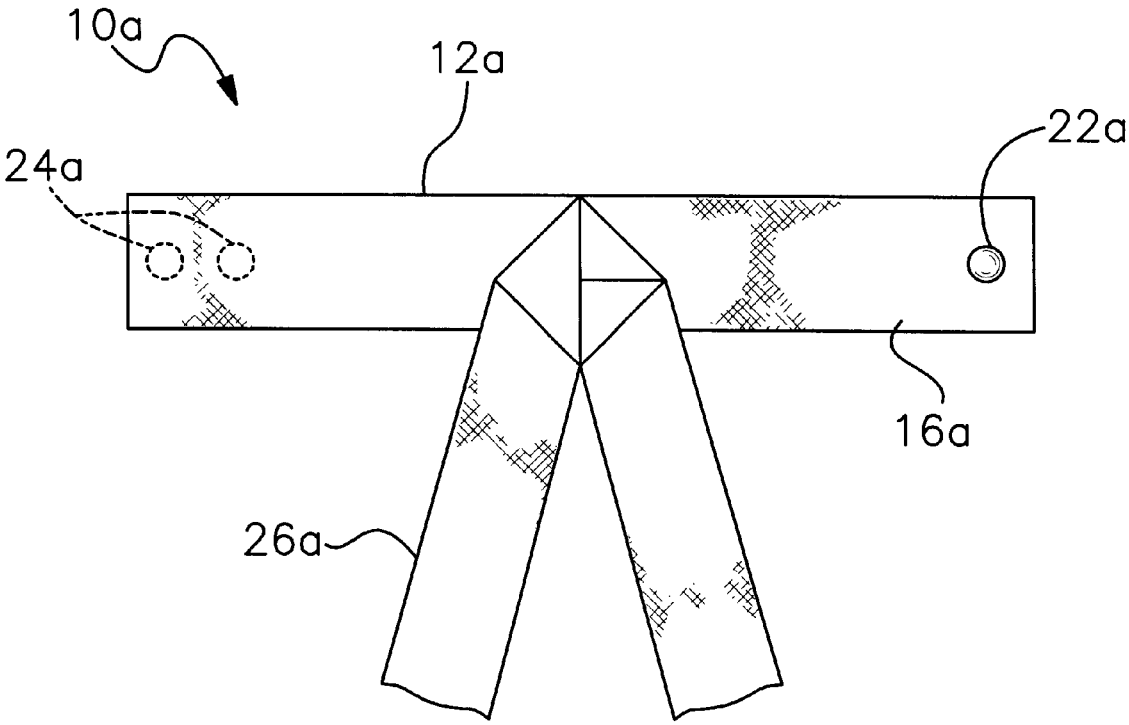
FIG. 2 is an elevational, front view of an alternative embodiment of the ornamental accessory wherein snap fasteners are used to close the band.

An alternative accessory 10*a* is shown in FIG. 2. Once again, a knot assembly 26*a* is secured to the outer surface of an elongate, flexible band 12*a*. In this version, a snap fastening element 22*a* is carried by the outside surface 16*a* of band 12*a*. A pair of complementary snap fasteners 24*a* are similarly carried by the opposing inside surface of band 12*a*. Accessory 10*a* is donned by wrapping band 12*a* about the wearer's wrist, ankle, etc. and fastening component 22*a* to either of complementary components 24*a*. Any number of components 24*a* may be employed so that the wearer may select the diameter of the band suitable for his or her body size. It should be understood that in alternative embodiments, the hook and loop or snap fasteners shown in FIGS. 1 and 2 may be replaced by other well known types of fasteners such as buttons, clips, etc. The hook and loop fastener shown in FIG. 1 may likewise include multiple components proximate at least one of the ends, or alternatively, may comprise an extended elongate fastening component proximate one or both ends. This analogously enables the diameter of the band to be adjusted as required.

In all other regards, the embodiment of FIG. 2 is constructed and operates, identically to the embodiment shown in FIG. 1. A flexible fabric or other lightweight and comfortable material is typically employed for both band 12*a* and knot assembly 26*a*. Appropriate indicia may be carried by both the outside surface of the band and the knot assembly.

Figure 3:
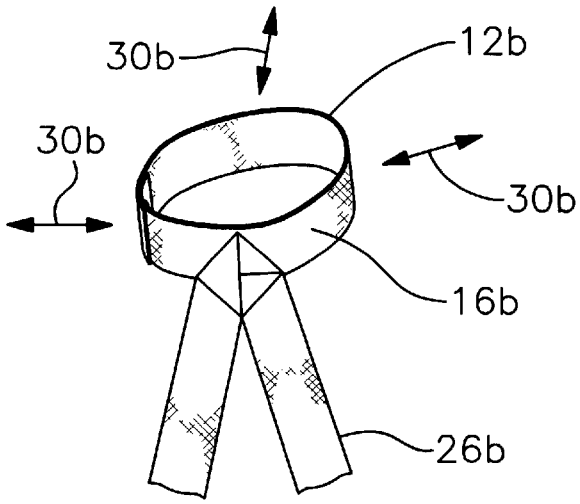
FIG. 3 is a perspective view of still another alternative embodiment of the accessory wherein a continuous resilient band is employed.

In the embodiment shown in FIG. 3, band 12*b* comprises a continuous, uninterrupted and generally annular element that encircles the wearer's wrist, ankle or other body part. Band 12*b* preferably comprises a resilient material that permits the diameter of the band to be adjusted conveniently as indicated by double headed arrows 30*b*. In this version, the band is engaged with the wearer's wrist, for example, by simply expanding the band and slipping it over the wearer's hand. The band is then positioned about the wrist and released so that the diameter of the band decreases and the accessory is held on the wearer's wrist. Once again, a knot assembly 26*b* is attached to the outer surface 16*b* of band 12*b*. The band and knot assembly carry appropriate indicia indicating a corresponding martial arts skill level.

Figure 4:
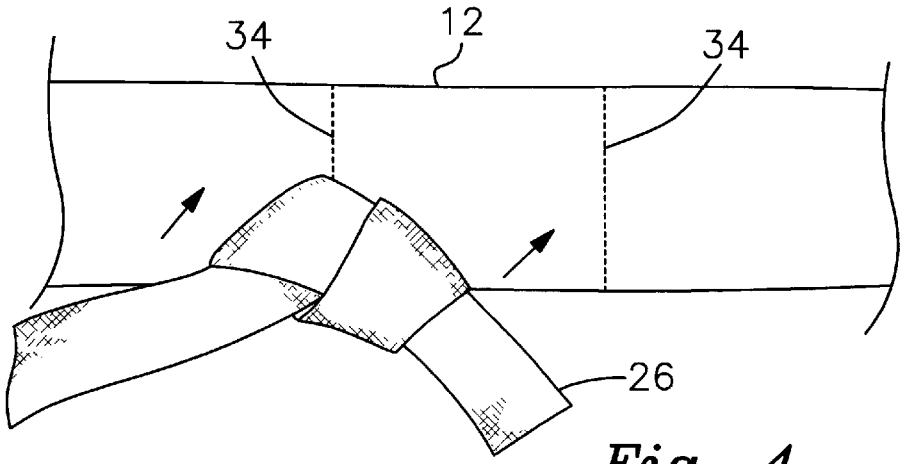
FIG. 4 is a perspective view of a version of the accessory that employs a one-piece knot assembly that is sewn onto the band.
Figure 5:
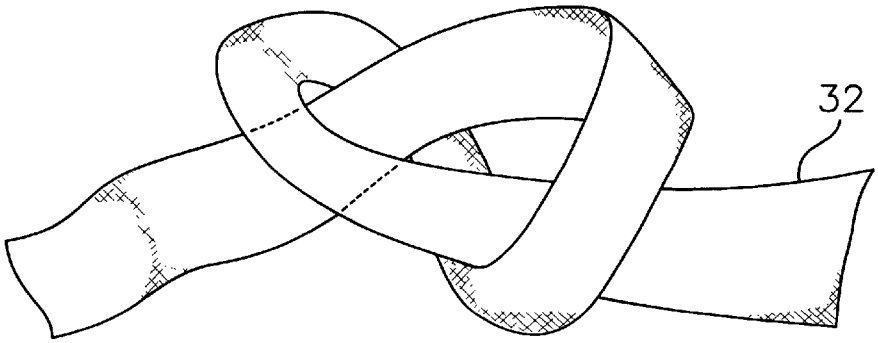
FIG. 5 is a perspective view of the one-piece knot assembly particularly illustrating how that knot is tied.

As shown in FIG. 4 and 5, knot assembly 26 (an analogously the knot assemblies shown in FIGS. 2 and 3) may comprise a single elongate knot component 32, which is composed of a flexible fabric or other material. The knot component 32 is tied in the manner best shown in FIG. 5 to define a standard martial arts knot. The manner of forming and tying this knot will be understood to persons skilled in the art and do not comprise a part of the invention. However, it is important that knot assembly 26 and its knot component 32 are separate and distinct from and are not formed unitarily (in one piece) with band 12, FIG. 4. In a standard martial arts belt, the knot is formed by tying together the unitarily attached ends of the belt itself. In this invention, knot assembly 26 is formed separately from band 12 and is attached to the band during construction of accessory 10. This attachment may be accomplished, for example, by sewing the tied knot assembly onto band 12 along seams 34, FIG. 4. Various sewing patterns may be employed within the scope of this invention. Alternatively, the knot assembly may be mounted onto the outer surface of the band by an adhesive or other known means.

Figure 6:
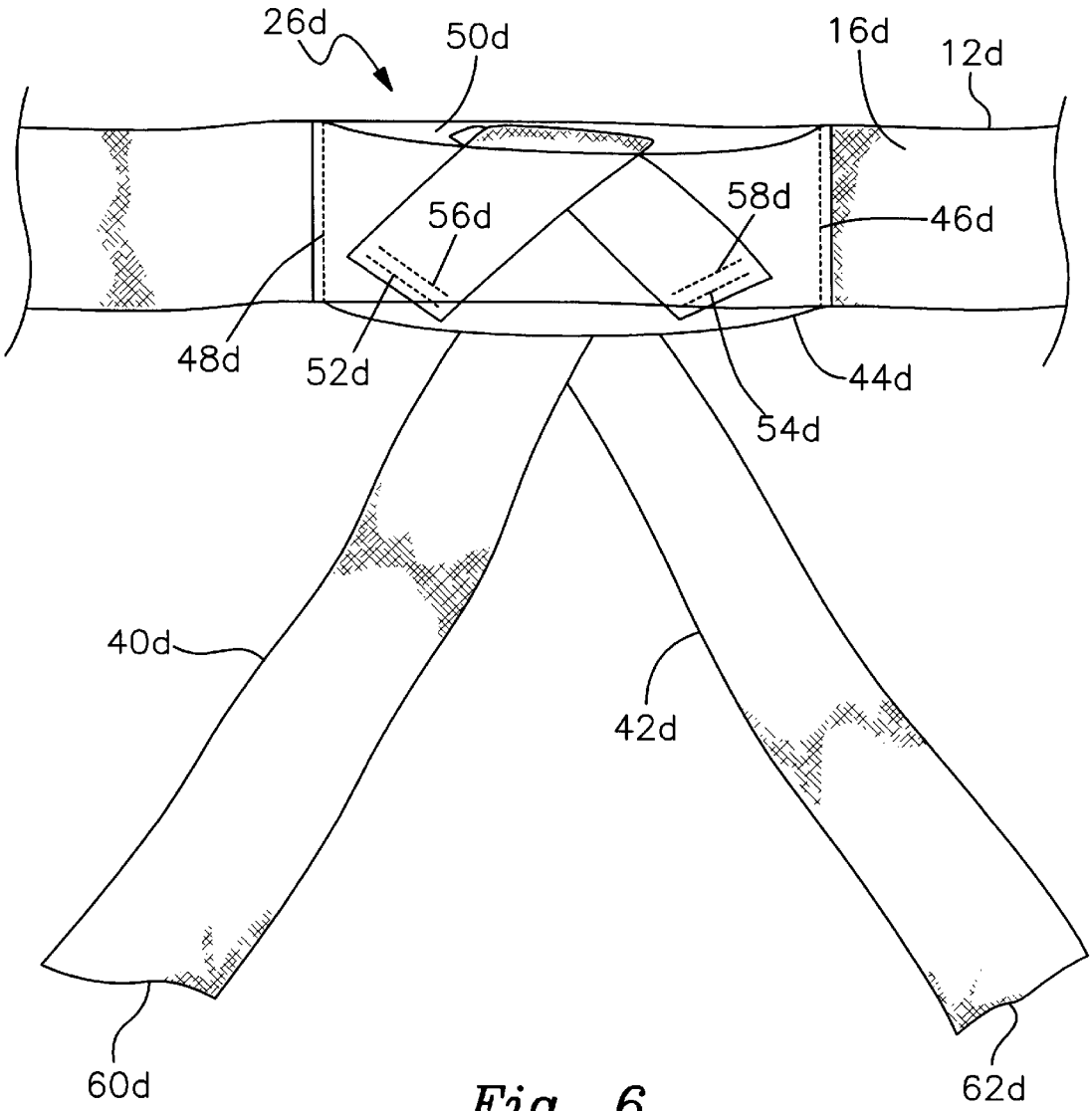
FIG. 6 is an elevational, front view of an embodiment of the ornamental accessory wherein the knot assembly includes a pair of separate knot components that are secured to and looped through a flexible loop element attached to the outer surface of the band.

In the alternative version, shown in FIG. 6, knot assembly 26*d* includes a pair of separate and distinct knot components 40*d* and 42*d*. Each of the knot components features a flexible, substantially flat piece of elongate fabric or other flexible material. The knot components are interengaged with band 12*d* to define a knot, which is mounted to the outer surface of the band. It should be understood that band 12*d* may be constructed in a manner identical or analogous to the band shown in any of the foregoing embodiments.

A loop element 44*d* is attached to the outer surface 16*d* of band 12*d*. In particular, loop element 44*d* comprises material that is similar or identical to the material comprising knot components 40*d* and 42*d* and band 12*d*. The knot component is sewn to the outer surface to band 12*d*, for example, along stitching 46*d* and 48*d*. The loop element is mounted loosely enough against the outer surface of the band so that the loop element may be pulled away from the band to define a space 50*d* between the loop element and the outside surface of band 12*d*. The upper ends 52*d* and 54*d* of knot components 40*d* and 42*d*, respectively, are secured to the outside surface of loop element 44*d*. More particularly, each of the knot components is orientated at a longitudinal angle relative to the loop element and underlying band. Knot component 40*d* is stitched or sewn along upper end 52*d* to the outer surface of the loop element along stitching 56*d*. Likewise, the upper end 54*d* of knot component 42*d* is sewn to the outer surface of loop element 44*d* along stitching 58*d*. Each of the components is wrapped over the upper edge of the loop element and inserted through space 50*d* between loop element 44*d* and 12*d* such that the knot components 40*d* and 42*d* intersect one another outside and inside the loop element. The lower ends or tails 60*d* and 62*d* of knot components 40*d* and 42*d* depend below band 12*d*. As a result, the loop element and crisscrossing knot components effectively define the knot assembly 26*d* which is secured to the outer surface 16*d* of band 12*d*. It should be understood that a variety of other techniques may be employed for forming a knot and attaching that knot to the outer surface of the band. Once again, appropriate indicia may be carried by the band and/or the knot assembly to represent a corresponding martial arts skill ranking.

Figure 7:
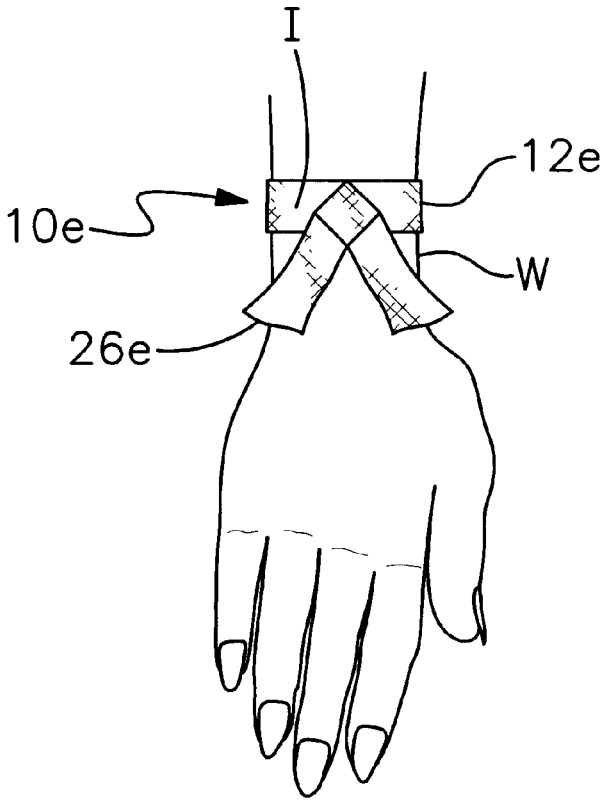
FIG. 7 is a elevational view illustrating the ornamental accessory being worn on the wrist to indicate the wearer's martial arts rank or skill level.

An accessory 10*e* in accordance with this invention is depicted being worn as a wrist band in FIG. 7. This wrist band is constructed according to the principles described in connection with FIGS. 1–6. A band 12*e* is worn about the wearer's wrist W. A knot assembly 26*e* is mounted to the outside surface of band 12*e*. The band may be continuous or may include opposing ends and releasable fastening means as previously described. A design or indicia I is carried by the outer surface of the band and the knot assembly. This again represents an associated martial arts skill level.

Figure 8:
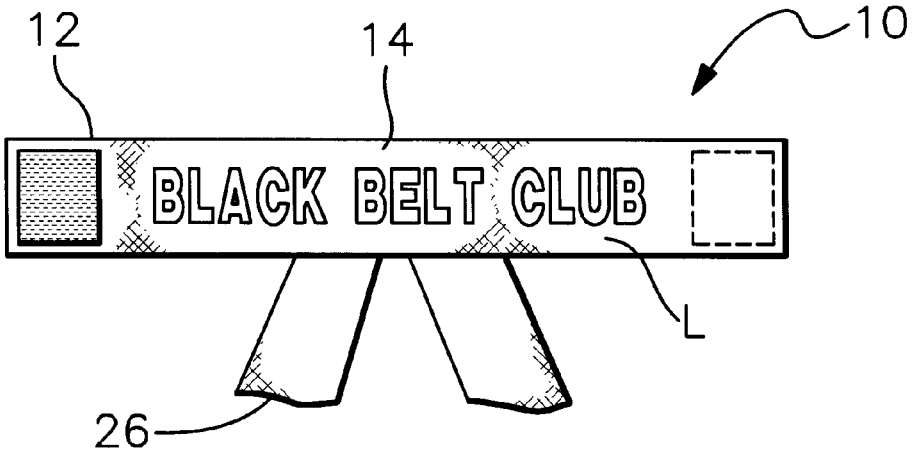
FIG. 8 is an elevational rearward view of the accessory bearing advertising or other printed matter on the inside surface of the band.

As shown in FIG. 8, the inside surface 14 of accessory 10 may include a printed logo L. The logo may comprise a business name, trademark or other printed advertising material. An almost endless variety of printed material may be carried on the inside surface of the band. Although such material may be printed on the outside of the band, preferably the outside bears only the indicia representing a particular skill level.

Accordingly, the present invention relates to a piece of jewelry or other type of ornamental accessory designed to be worn by a person so that the person may proudly indicate to others the particular marital arts ranking that the wearer has attained. This is a novel and attractive, and yet fairly subtle way of displaying one's accomplishments in a particular martial arts discipline.

From the foregoing it may be seen that the apparatus of this invention provides for an ornamental accessory and, in particular, a bracelet, anklet or similar item of jewelry that is intended to be worn and which indicates a rank or skill level that has been attained by the wearer in one of the martial arts. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An ornamental accessory for wearing by a person on a portion of the person's body, said accessory representing a selected martial arts skill level, said accessory comprising:

a flexible band having generally flat inside and outside surfaces for encircling a portion of the wearer's body other than the wearer's torso; and a knot assembly separate and distinct from, and not unitarily joined to said band, said knot assembly including a pair of separate and distinct, elongate, flexible and generally flat knot components mounted on said outside surface of said band and depending therefrom to define a pair of tail portions, said knot assembly further including a flexible loop element attached to said outside surface of said band, each of said pair of knot components being attached to said loop element and insertible between said loop element and said band to form said knot assembly, at least one of said band and said knot assembly including indicia for representing a selected martial arts skill level.

2. The accessory of claim 1 in which said band includes a continuous, generally annular member that is composed of a resilient material.

3. The accessory of claim 1 in which said band includes an elongate member having a pair of opposing ends, said elongate member carrying complementary means for fastening the elongate member to itself proximate said opposing ends to define said band.

4. The accessory of claim 3 in which said complementary means for fastening comprise a pair of complementary hook and loop fastening elements.

5. The accessory of claim 1 in which said pair of knot components are sewn to an outside surface of said loop element.

6. An ornamental accessory for wearing by a person on a portion of the person's body, said accessory representing a selected martial arts skill level, said accessory comprising:

an elongate, flexible band having generally flat inside and outside surfaces for encircling a portion of the wearer's body other than the wearer's torso; and a knot assembly separate and distinct from, and not unitarily joined to said band, said knot assembly including a pair of separate and distinct, elongate, flexible and generally flat knot components mounted on said outside surface of said band at respective, longitudinally spaced apart locations thereon and depending from said band to define a pair of tail portions, said pair of knot components being interengagable to form said knot assembly and at least one of said band and said knot assembly including indicia for representing a selected martial arts skill level.

* * * * *